United States Patent [19]

Landers

[11] 4,087,978

[45] May 9, 1978

[54] MULTIPLE DIAPHRAGM SEAL ASSEMBLY

[75] Inventor: Don B. Landers, Arlington, Tex.

[73] Assignee: Oil States Rubber Company, Arlington, Tex.

[21] Appl. No.: 574,919

[22] Filed: May 6, 1975

[51] Int. Cl.[2] ..... E02D 5/00

[52] U.S. Cl. ..... 61/53; 61/86; 61/98

[58] Field of Search ..... 61/46, 46.5, 53, 86, 61/98; 138/89; 220/68, 85 B, 256, 257, 258, 327; 277/237; 285/3, DIG. 2, 200; 52/63, 80, 208

[56] References Cited

U.S. PATENT DOCUMENTS

| | | | |
|---|---|---|---|
| 2,331,097 | 10/1943 | Watter | 220/85 B |
| 3,009,845 | 11/1961 | Wiser | 52/208 |
| 3,533,241 | 10/1970 | Bowerman et al. | 61/46.5 |
| 3,605,947 | 9/1971 | Salerno et al. | 285/3 X |
| 3,807,105 | 4/1974 | Rudkin et al. | 52/80 X |
| 3,837,178 | 9/1974 | Hackforth et al. | 285/200 X |

*Primary Examiner*—Paul R. Gilliam
*Assistant Examiner*—David H. Corbin
*Attorney, Agent, or Firm*—Warren H. Kintzinger

[57] ABSTRACT

A seal assembly for tubular structures such as piling guides and the like, with a plurality of stacked diaphragm members forming enclosed chambers therebetween at the tube ends. The chambers are filled with plastic or elastomer for differential pressure sharing between the diaphragms to avoid overloading and rupture thereof.

9 Claims, 2 Drawing Figures

MULTIPLE DIAPHRAGM SEAL ASSEMBLY

Figure 1:
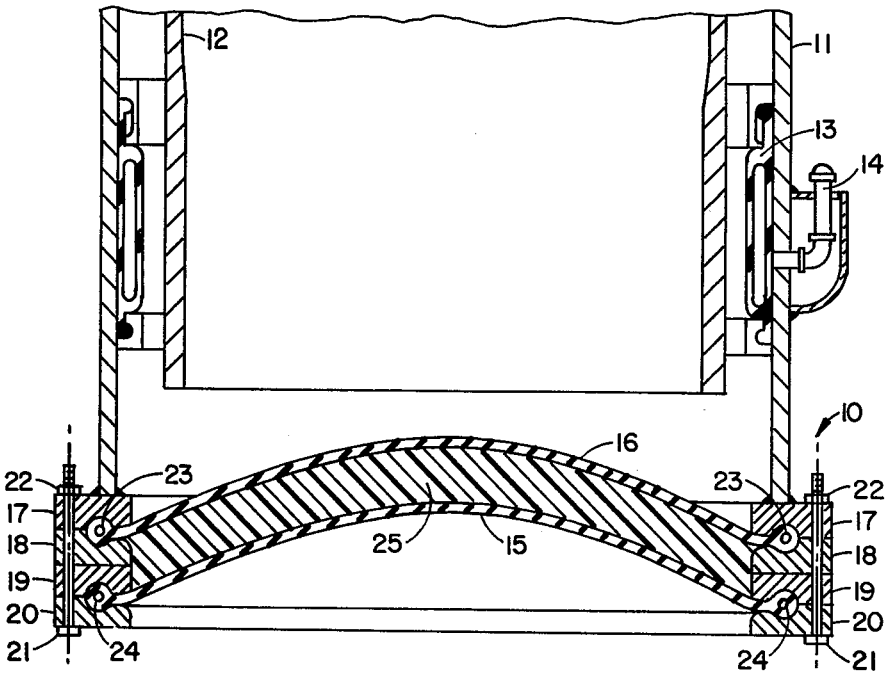

This invention relates in general to seal assemblies utilizing diaphragms, and in particular, to multi-diaphragm seal assemblies for withstanding relatively high pressures.

In recent years the installation of marine drilling platforms and similar offshore structures has been simplified by the use of rupturable seal assemblies for the piling guides. Such assemblies are disclosed in U.S. Pat. No. 3,533,241, issued Oct. 31, 1970 and assigned to the assignee of this invention — disclosure of which is incorporated herein by reference. These seal assemblies generally close the lower ends of the upright tubular legs, or piling guides, of the marine drilling platforms and are lowered to such ocean, sea, or other off-shore depths, that they must be designed to withstand extremely high pressures while also being susceptible to piercing by pilings driven therethrough. Heretofore lower ends of piling guides and/or standards have been closed by metal plates fastened therein, or by mounting heavy metal caps on tube ends. These, however, are difficult to displace and knock out of the way by driven piling. Another approach has been to construct massive, heavy diaphragms with strength to withstand a rather high pressure differential. Disadvantageously, however, massive diaphragms such as these are excessively stiff, difficult to handle, and expensive. A better approach is to use a plurality of diaphragms, in a stacked configuration, defining chambers therebetween. Such an approach has been used with the chambers filled with water, a relatively incompressible fluid. When properly water-filled the chambers distribute the applied stress, with a single pressure-sharing diaphragm thereby called upon to withstand only a portion of the overall pressure differential. To work properly, the water-filled chambers between the diaphragms must be filled completely. Occasionally, water leaks from these chambers prematurely or the chambers are not completely filled originally to thereby cause an unbalanced sharing of the pressure by the diaphragms that is a contributing cause factor in undesired diaphragm rupture.

It is therefore a principal object of this invention to provide a rupturable multi-diaphragm seal assembly.

Another object is to provide such a seal assembly capable of withstanding relatively high pressures.

A further object is to provide such a seal assembly utilizing a plurality of diaphragms with a plurality of material filled chambers adapted for differential pressure sharing therebetween.

Features of this invention useful in accomplishing the above objects include, a plurality of stacked and separated diaphragm members forming enclosed chambers filled with a plastic or elastomer material.

A specific embodiment representing what is presently regarded as the best mode of carrying out the invention is illustrated in the accompanying drawing.

Figure 2:
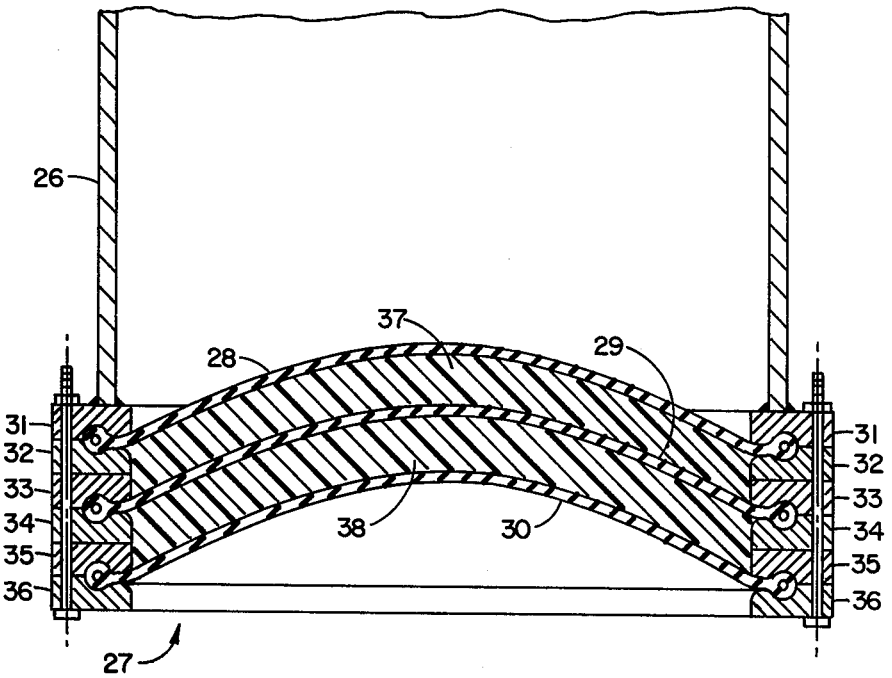

In the drawing:

FIG. 1 represents a sectional view of a two-diaphragm seal assembly for a piling guide constructed in accordance with the principles of this invention; and FIG. 2, a sectional view of a three-diaphragm seal assembly for a tubular member.

Referring to the drawing:

Seal assembly 10 is shown mounted on the lower end of piling guide 11, within which piling 12 is contained. After piling guide 11 is lowered, piling 12 is driven through seal assembly 10 to anchor the structure including piling guide 11, to the bottom of the body of water, as described in the aforementioned patent. Inflatable packer assembly 13, as described in U.S. Pat. No. 3,468,132, is inflated by compressed air entering through pipe 14 to form an annular seal between the outside of piling 12 and the inside of piling guide 11 so that injected fresh grout may be retained in the annular region between piling 12 and piling guide 11.

Seal assembly 10 is seen to illustratively include a pair of diaphragm members 15 and 16 that may be of the type described in U.S. Pat. No. 3,533,241. Seal assembly 10 further includes annular flange members 17, 18, 19, and 20. Flange member 17 is illustratively shown as being welded to the end of piling guide 11. Annular flange members 18, 19, and 20 are then secured to annular flange member 17, and to each other, by means of bolts 21 and nuts 22, as shown. Diaphragms 15 and 16 are elastic, and are typically fabricated of nylon-corded rubber having their peripheries wrapped around reinforcing rings 23 and 24, as described in U.S. Pat. 3,533,241. Annular flange members 17, 18, 19, and 20 have annular grooves therein that are adapted to secure the thickened peripheral rims of diaphragms 15 and 16, as shown in FIG. 1. Annular flange members 18 and 19 also act as spacers for diaphragms 15 and 16 so that, in conjunction therewith, an enclosed chamber is formed. In accordance with the principles of this invention, the enclosed chamber is filled with a relatively incompressible substance such as a plastic or an elastomer material 25, for example, urethane rubber. The chosen relatively incompressible material 25 should entirely fill the space between diaphragms 15 and 16 so that any externally applied pressure, such as that encountered at great water depths, is evenly distributed between the diaphragms 15 and 16. This advantageously allows more manageable diaphragms to be utilized than in the case where only a single thick diaphragm is used.

Referring also to FIG. 2, a hollow tubular member 26 is shown to be terminated by seal assembly 27. Tubular member 26 may be, for example, a hollow pipe utilized as part of an underwater pipeline where it is desired to seal the pipe to prevent any contaminants, such as silt, and/or marine life and other substances from entering the pipeline prior to oil being piped therethrough. Seal assembly 27 is similar to seal assembly 10 (FIG. 1) but comprises three diaphragms 28, 29 and 30 secured by annular flange members 31, 32, 33, 34, 35 and 36. The combination of diaphragms 28, 29, and 30 and annular flange members 32, 33, 34 and 35, form two chambers that are completely filled with a substantially incompressible substance such as a plastic or elastomer material 37 and 38. In the three diaphragm seal assembly 27, pressure is distributed among the three diaphragms.

Whereas this invention is herein illustrated and described with respect to particular embodiments thereof, it should be realized that various changes may be made without departing from the essential contributions to the art made by the teachings hereof. For example, although embodiments showing two and three diahragms are illustrated, it is expressly understood that the scope of this invention includes any number of diaphragms, depending upon the particular application and the pressures anticipated.

I claim:

1. In combination with a water immersible hollow tubular member such as an underwater piling guide and the like, a seal assembly for closing the immersible end of said hollow tubular member, including: a plurality of flexible diaphragm structures each comprising a sheet of rubber-like material of a type substantially deflectable and distortable when subject to a predetermined differential fluid pressure induced uniformly distributed loading; means for individually sealingly clamping the periphery of each of said diaphragm structures across said immersible end of said hollow tubular member in a spaced-apart, paralleled relationship, with each opposing space-separated surface-pair of adjacent ones of pairs of said diaphragm structures and inner surface portions of said means for clamping defining inner walls of a chamber; and a flexible force transmission media material completely filling each said chamber, with outer surfaces of said material in intimate engagement with said inner walls of said chamber and in unclamped engagement with said means for clamping; said force transmission media material being of a type readily conformable with changing shape of said chambers effected by flexing and distortion imparted to said diaphragm structures without appreciable compression of said force transmission media material, to thereby effect a sharing of fluid pressure induced uniformly distributed loading by said plurality of diaphragm structures.

2. The seal assembly of claim 1, wherein said material is an elastomer.

3. The seal assembly of claim 2, wherein said elastomer material is urethane rubber.

4. The seal assembly of claim 1, wherein two diaphragm structures enclose a single chamber filled with said substantially incompressible material.

5. The seal assembly of claim 1, wherein said plurality of diaphragm structures enclose a plurality of chambers filled with said substantially incompressible material.

6. The seal assembly of claim 5, wherein three diaphragm structures enclose two adjacent chambers filled with said substantially incompressible material.

7. In combination with a water immersible hollow tubular member such as underwater piling guides and the like, a seal assembly for closing the immersible end of said hollow tubular member, including: a plurality of circular elastic diaphragm structures each comprising a sheet of rubber-like material and having a thickened peripheral portion and of a type substantially deflectable and distortable when subjected to a predetermined differential fluid pressure induced uniformly distributed loading; a plurality of annular flange clamp member pairs opposing faces of which define an annular groove within which is received the thickened peripheral portion of one of said diaphragm structures, means attaching a first one of said flange clamp member pairs to said immersible end of said tubular member, means attaching the others of said flange clamp member pairs to said first flange clamp member pair in spaced-apart axially aligned relationship therewith; with each opposing space-separated surface-pair of adjacent ones of pairs of said diaphragm structures and inner surface portions of said flange clamp members defining inner walls of a chamber; and a flexible force transmission media material completely filling each said chamber, with outer surfaces of said material in intimate engagement with said inner walls of said chamber and in unclamped engagement with said means for clamping; said force transmission media material being of a type readily conformable with changing shape of said chambers effected by flexing and distortion imparted to said diaphragm structures without appreciable compression of said force transmission media material, to thereby effect a sharing of fluid pressure induced uniformly distrubted loading by said plurality of diaphragm structures.

8. The seal assembly of claim 7, wherein said material is an elastomer.

9. The seal assembly of claim 8, wherein said elastomer material is urethane rubber.

* * * * *